US005819342A

United States Patent [19]

Williams

[11] Patent Number: 5,819,342

[45] Date of Patent: Oct. 13, 1998

[54] FOLDABLE PLAYYARD WITH LATCH LOCKING HUB SYSTEM

[75] Inventor: Bruce Leslie Williams, Narvon, Pa.

[73] Assignee: Graco Children's Products Inc., Elverson, Pa.

[21] Appl. No.: 795,399

[22] Filed: Feb. 5, 1997

[51] Int. Cl.[6] ..... A47D 7/00

[52] U.S. Cl. ..... 5/99.1; 5/98.1; 248/167

[58] Field of Search ..... 5/99.1, 93.1, 98.1; 248/167

[56] References Cited

U.S. PATENT DOCUMENTS

| | | | |
|---|---|---|---|
| D. 304,523 | 11/1989 | Dillner et al. | 5/99.1 |
| 1,374,333 | 4/1921 | Stotler et al. . | |
| 2,197,791 | 4/1940 | Eddy . | |
| 2,498,203 | 2/1950 | Fischer | 5/98.1 |
| 2,574,079 | 11/1951 | White | 5/99.1 |
| 2,587,511 | 2/1952 | Nerman | 248/169 |
| 2,630,289 | 3/1953 | Selig | 248/169 |
| 2,962,034 | 11/1960 | Finlayson . | |
| 3,091,249 | 5/1963 | O'Neil . | |
| 3,810,482 | 5/1974 | Beavers . | |
| 4,008,499 | 2/1977 | Wren, Jr. et al. | 5/99.1 |
| 4,124,909 | 11/1978 | Saeedy | 5/99.1 |
| 4,688,280 | 8/1987 | Kohus et al. | 5/99.1 |
| 4,739,527 | 4/1988 | Kohus et al. | 5/99.1 |
| 4,811,437 | 3/1989 | Dillner et al. | 5/99.1 |
| 5,279,006 | 1/1994 | Teng | 5/99.1 |
| 5,358,220 | 10/1994 | Yu-Kuang | 5/99.1 |
| 5,697,111 | 12/1997 | Dillner et al. | 5/99.1 |

FOREIGN PATENT DOCUMENTS

| | | | |
|---|---|---|---|
| 43051 | of 1910 | Australia | 5/99.1 |
| 2361846 | 3/1978 | France . | |

*Primary Examiner*—Alexander Grosz
*Attorney, Agent, or Firm*—Richard B. O'Planick

[57] ABSTRACT

A foldable playyard includes a lower frame assembly including a hub and a plurality of hub legs with one end portion of each of the hub legs pivotally coupled to the hub. The foldable playyard also includes an upper frame assembly including a plurality of side rail units, each including a pair of rails and a medial rail connecting member pivotally connecting one end portion of each rail, the medial rail connecting member enabling the pair of rails to be collapsible from a substantially in-line configuration to a substantially V-shaped configuration. Also included are corner legs for interconnecting the upper and lower frame assemblies. The hub includes a locking member and at least one of the hub legs includes an engaging portion adjacent to the locking member to prevent the hub leg from pivoting relative to the hub.

40 Claims, 6 Drawing Sheets

FOLDABLE PLAYYARD WITH LATCH LOCKING HUB SYSTEM

BACKGROUND OF THE INVENTION

1. Field of the Invention

The present invention relates to a foldable playyard with an improved latch locking hub system, and more particularly, to a system wherein hub legs can be easily locked and unlocked.

2. Discussion of the Related Art

An easily transportable playyard of a simplified structure having upper and lower frame assemblies, which is easily erectable and collapsible without re-assembly or disassembly of any parts is described in U.S. Pat. No. 4,811,437 and shown in Des. 304,523 issued to Dilner et al., the entire disclosures of which are incorporated herein by reference. The '437 patent describes a foldable playyard comprising upper and lower frame assemblies.

The lower frame assembly thereof comprises a hub, four lower corner leg connecting members and four hub legs. Each hub leg is pivotally coupled at one end portion to the hub and pivotably coupled to one of the corner leg connecting members at the opposite end portion thereof. The hub comprises a hub body having hub leg receiving sockets or recesses which permit the hub legs to pivot from a substantially horizontal co-planar spread-out configuration where the hub legs diverge outwardly from the hub to a compact non-coplanar configuration where the hub legs can be positioned substantially parallel.

The upper frame assembly thereof includes four upper corner connecting members and four foldable side rail units. Each rail unit has a pair of rails pivotally joined by a medial rail connecting member having a latching mechanism, which enables the rail pair to fold relative to each other from a substantially in-line configuration to a generally V-shaped configuration and vice-versa.

Four corner legs are connected to the upper corner connecting members and lower corner connecting members such that the corner legs are collapsible radially inwardly towards the hub in a substantially parallel compact configuration wherein the corner legs are drawn together by the hub legs and side rails.

When the playyard is in the erected use position, the hub legs are prevented from pivoting relative the hub since the weight of the hub and the hub legs and the playyard's removable and foldable floor member can maintain the hub legs in the horizontal coplanar spread configuration. However, there can be instances where the floor member is raised above the plane of the hub and the hub legs such as, for example, when using a raised bassinet. As an added precaution, it would be desirable to maintain the playyard in a locked erected state where the hub legs remain in horizontal coplanar spread-out configuration at all times, especially when the floor member is raised or even removed.

SUMMARY OF THE INVENTION

Accordingly, the present invention is directed to a foldable playyard and improved hub system that substantially obviate one or more of the problems due to limitations and disadvantages of the related art.

An object of the present invention is the provision of a foldable playyard wherein the hub legs are maintained in a horizontal coplanar spread configuration when the playyard is in the erected use position.

Another object of the present invention is the provision of a foldable playyard including hub legs which can be easily locked and unlocked.

A further object of the present invention is the provision of an improved hub system for a foldable playyard.

A still further object of the present invention is the provision of an improved unlocking member which is reliable and easy to operate and whose structure and shape provide intuitive guidance on the correct operation.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the folding playyard includes a foldable playyard including lower frame assembly including a hub and a plurality of hub legs, one end portion of each of the hub legs pivotally coupled to the hub, an upper frame assembly including a plurality of side rail units, each including a pair of rails and a medial rail connecting member pivotally connecting one end portion of each rail, said medial rail connecting member enabling the pair of rails to be collapsible from a substantially in-line configuration to a substantially V-shaped configuration, corner legs for interconnecting the upper and lower frame assemblies, wherein the hub includes a locking member and at least one of the hub legs includes an engaging portion adjacent to the locking member to prevent the hub leg from pivoting relative to the hub.

In another aspect, the hub system for connecting one end portion of each of a plurality of legs of a lower frame assembly of a playyard, includes a hub body for pivotally coupling to one end portion of at least one leg, a locking member on the hub body, an engaging portion on at least one leg and adjacent to the locking member for cooperating with the locking member to prevent the leg from pivoting.

In a further aspect, the device for preventing pivotal movement of a leg, includes a leg receiving body, a leg pivotally coupled to the body, a locking member on the body, and an engaging member slidably connected on the leg for cooperation with the locking member.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
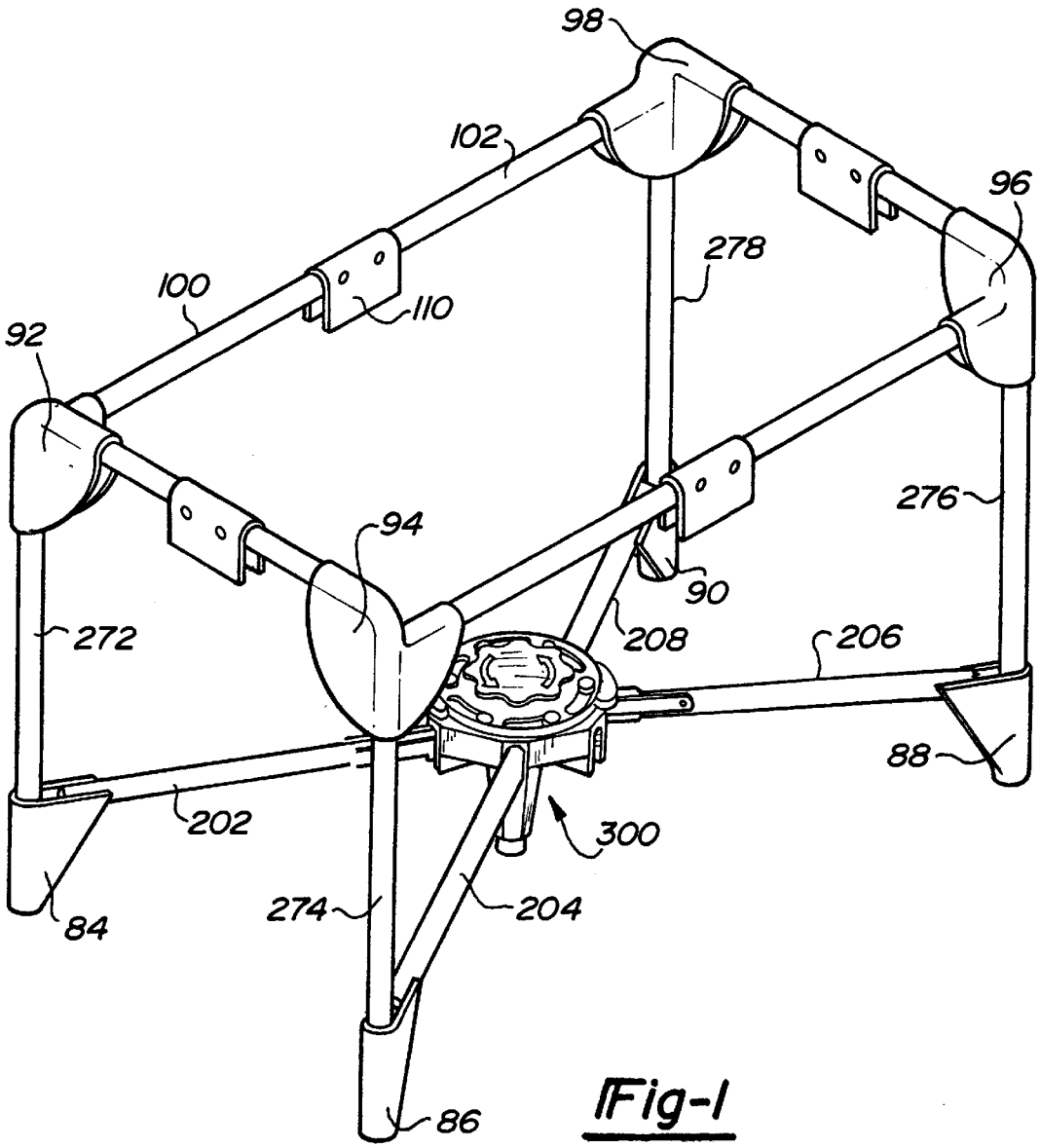
FIG. 1 is a perspective view of the frame of the playyard.

FIG. 1 shows the frame of a playyard according to the present invention in an erected state. The playyard has a frame generally defined by a lower frame assembly, an upper frame assembly, corner legs, and hub unit.

The upper frame assembly comprises four substantially identical side rail units connected to four substantially identical upper corner connecting members 92, 94, 96 and 98. Each rail unit includes a pair of substantially rigid, tubular rails 100, 102, which may be made from any suitable material, such as a 22 gauge steel tube, and a medial rail connecting member 110. The lengths of the respective rails can be made to accommodate any size square or rectangular configuration of the playyard. The corner connecting members may be molded, for example, from a polymeric plastic materials such as ABS, polypropylene, nylon, etc. Each pair of adjacent corner connecting members (92, 94; 94, 96; 96, 98; and 98, 92) supports one of the side rail units at the upper portion of the playyard frame.

The medial rail connecting member 110 is preferably made of a substantially rigid material and is provided with opposed cut-outs to facilitate pivoting of rails 100, 102. The end portion of the rail extends within and is pivotably coupled to an associated upper corner connecting member by a rivet pin, or the like. The opposite end portion of the rail extends within and is pivotably coupled to the medial rail connecting member 110.

Each of the medial rail connecting members 110 houses a latch mechanism for latching the rails 100, 102 in a substantially in-line configuration when the playyard is erected.

The lower frame assembly of the playyard frame includes four substantially identical lower corner leg connecting members 84, 86, 88, 90, preferably in the form of support feet, and four substantially identical hub legs 202, 204, 206 and 208, and a hub 300. The lower corner connecting members also may be molded, for example, from any suitable polymeric plastic materials such as ABS, polypropylene, nylon, etc. The hub legs are preferably formed straight and may be made from any suitable substantially rigid material such as a 22 gauge steel tubing. The lower frame assembly can also include a pair of support legs (not shown) for supporting the playyard on a fixture such as a floor. Each support leg includes a generally straight section which is pivotally connected to the hub and a curved free end or foot support portion. The support leg can be made from the same tubing material and tubing dimension as the hub legs.

One end portion of each of the hub legs is pivotably coupled to one of the lower corner connecting member 84, 86, 88, 90 and the other end portion of each of the hub legs is pivotally coupled to the hub which is described in detail hereinbelow. One end portion of each hub leg is provided with diametrically opposed openings in alignment with like openings in the associated lower corner connecting member and is pivotably coupled thereto by a rivet, pin, or the like, (see 337 in FIG. 2) which extends through the aligned hub leg and lower corner connecting member openings.

Each lower corner connecting member 84, 86, 88, and 90 is provided with a hollow interior clearance space to accommodate pivoting movement of the hub leg end portion so as to enable movement of the hub leg from a substantially co-planar horizontal spread-out configuration wherein the hub legs diverge outwardly from the hub to a compact non-coplanar configuration where the hub legs can be positioned substantially parallel. Each lower corner connecting member is also provided with a leg support portion which supports the end portion of the hub leg when the leg is in the substantially horizontal position, with the playyard erected.

Each of the corner legs 272, 274, 276, and 278 is connected to one of the lower corner connecting member 84, 86, 88, and 90 and one of the upper corner connecting member 92, 94, 96, and 98. In this regard, each lower corner connecting member is provided with a socket for receiving a lower end portion of one of the four corner legs which can made of any suitable substantially rigid material such as a 22 gauge steel tubing. Similarly, each of the upper corner connecting members is provided with a socket for receiving the upper end portion of one of the four corner legs. The end portions of each corner leg are fixedly secured to the associated lower corner connecting member and the upper corner connecting member by a rivet, pin, or the like. Thus, each corner leg is fixedly secured to an upper corner connecting member which is part of the upper frame assembly of the playyard and to a lower corner connecting member which is part of the lower frame assembly of the playyard.

The corner legs 272, 274, 276, and 278 are spaced apart and upstanding in a substantially parallel configuration as shown in FIG. 1 when the playyard is erected. The hub legs are oriented substantially horizontally in a horizontal plane and the side rails are oriented substantially in-line so as to spread the corner legs in this configuration.

Figure 2:
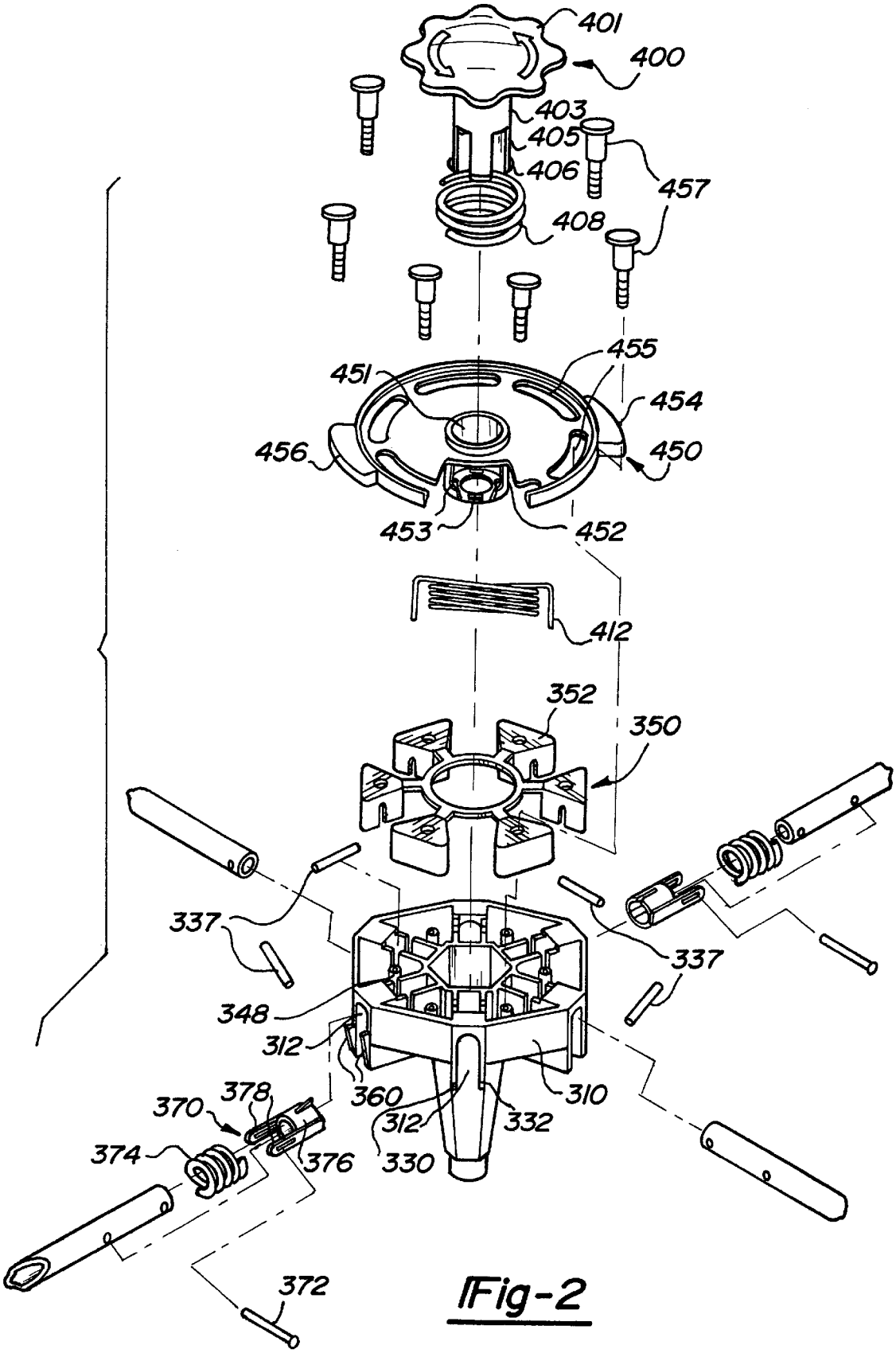
FIG. 2 is an exploded view of the hub unit.

As better shown in FIG. 2, the hub 300 according to the present invention comprises a hub body 310, including a spider cover 350 for maintaining the pins 337 in their respective position relative to the hub body, a locking member 360 and a knob unit 400.

Specifically, the hub body 310 is preferably generally hexagonal in shape, although any other suitable configuration can be used. The hub body includes a first side (top) and a second side (bottom). The second side of the hub body 310 includes six leg receiving recesses or sockets 312, to which an end portion of each of the four hub legs 202, 204, 208 and 210 and each of the support legs are pivotally attached. The sockets are dimensioned to accommodate the end portions of the hub legs such that the hub legs can be collapsible from a substantially co-planar spread-out configuration where the hub legs diverge outwardly from the hub to a compact non-coplanar configuration where the hub legs can be positioned substantially parallel.

Each leg receiving socket is defined by a pair of opposed side walls 330 and 332 provided with collinearly aligned slots, for receiving a pivot pin 337. Each leg receiving socket also includes a side end wall portion, a partial top wall having a substantially arcuate support surface underneath thereof for supporting the hub legs 202, 204, 208, and 210, and the support legs. The side end wall portion and a bottom wall form a substantially cylindrical cup-like chamber substantially centrally of the hub body. The end portion of each hub leg is provided with aligned, diametrically opposed openings for receiving the pivot pin 337. The socket walls 330 and 332 are sufficiently spaced apart to provide a clearance for the hub leg to substantially freely pivot from a substantially co-planar horizontal spread configuration wherein the hub legs diverge outwardly from the hub to a compact non-coplanar configuration where the hub legs can be positioned substantially parallel. Alternatively, the opposed side walls 330 and 332 can be made to slightly converge to frictionally engage the end portion of the hub leg and maintain the hub legs in the horizontal position if desired.

After each of the hub legs is inserted in the leg receiving sockets, the spider cover 350 which includes six individual covers 352 corresponding to the geometry of the six wells is installed, followed by spring 412 and unlocking member 450. These components are collectively fastened to the hub body 310, using shoulder screws 457 to maintain the pivot pins 337 secured in place and to retain and rotationally align the unlocking member 450. The hub body and the spider are preferably molded from a polymeric plastic material such as ABS, polypropylene, nylon, etc. Each of the triangular-shaped wells is provided with a circular rib 348 projecting upwardly from the well's bottom wall. The rib can serve to receive a fastening screw for holding the spider cover and unlocking member 450 to the hub body and to prevent lateral movement of the pivot pins in adjacent leg receiving sockets. Although the preferred embodiment is shown with a spider cover to maintain the pivot pins seated within the slots, any other conventional means can also be used to carry out the same function, such as pin retainers.

Figure 3:
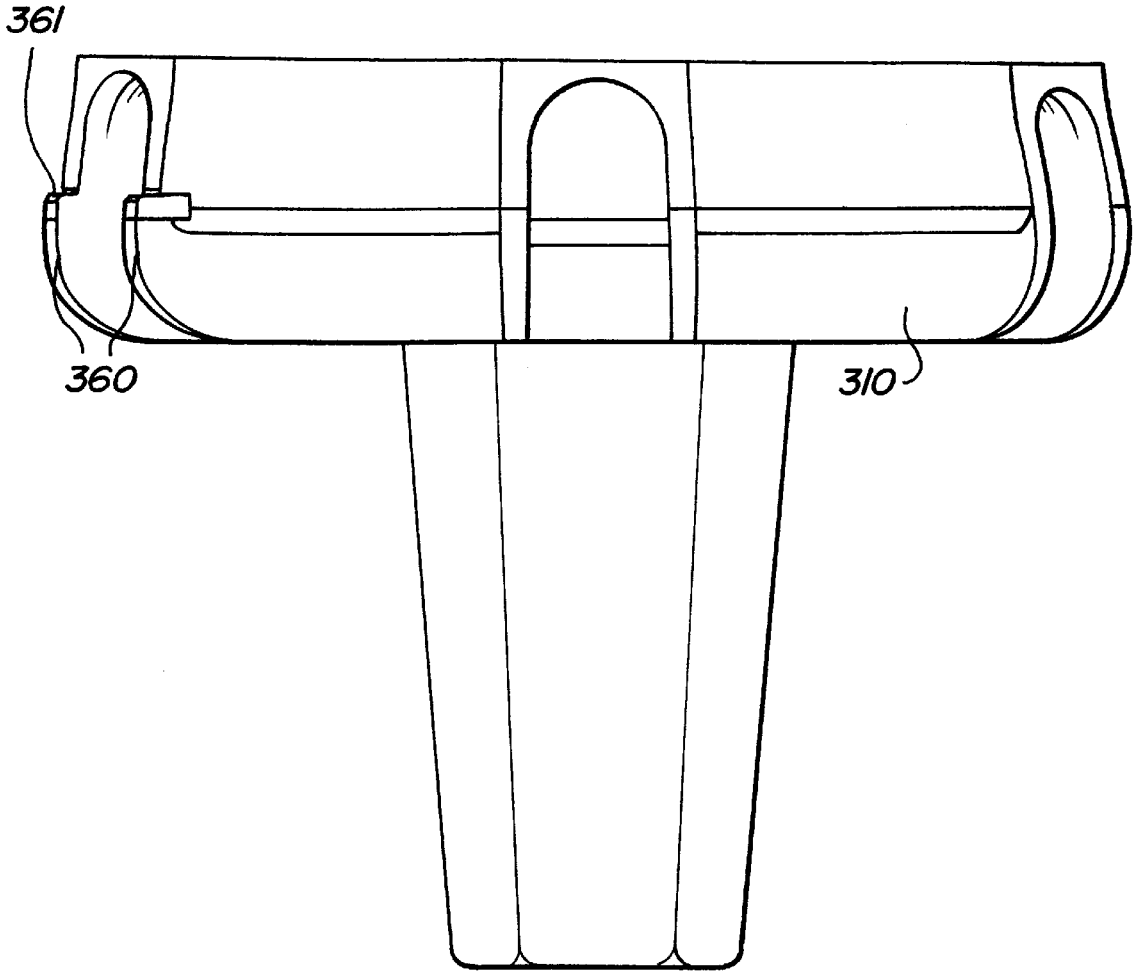
FIG. 3 is a perspective view of the hub body.

The hub body 310 includes locking members 360, one of which is shown in detail in FIG. 3. The locking members cooperate with engaging portions 370 slidably connected on hub legs.

Figure 4:
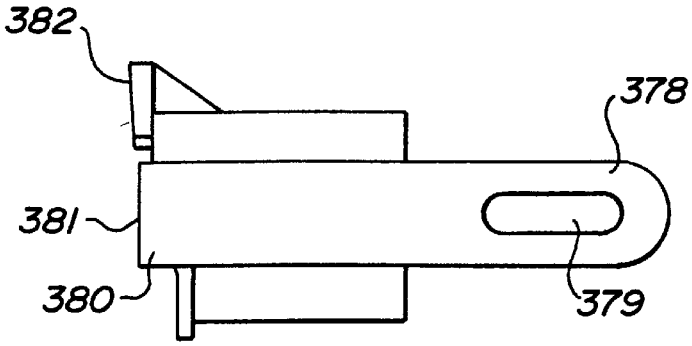
FIG. 4 is a perspective view of the engaging portion.
Figure 5A:
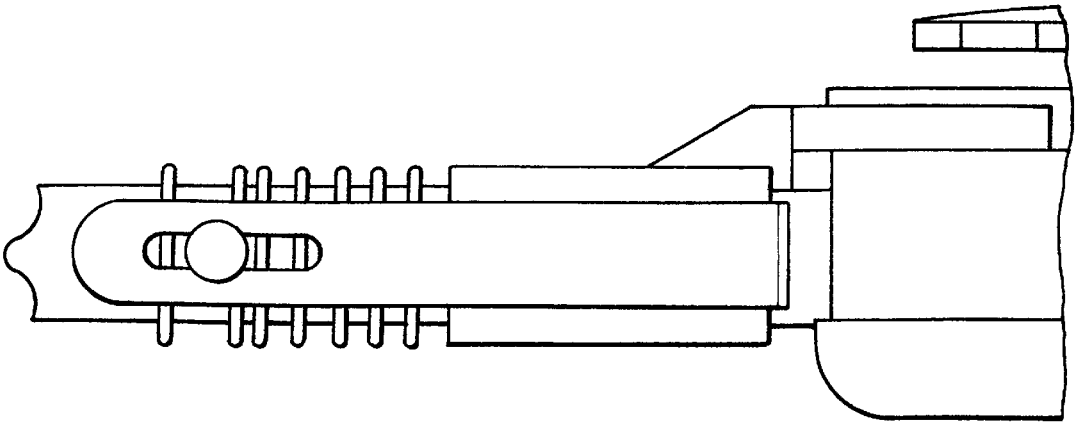
FIGS. 5A and 5B are top and bottom views, respectively, of the hub body and engaging portion.
Figure 5B:
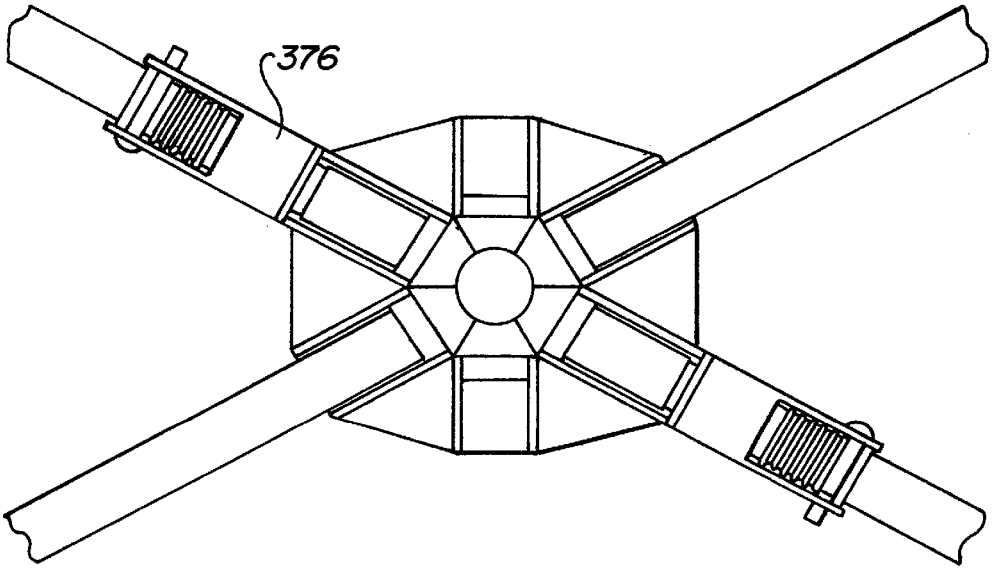

Engaging portion 370 includes a pin, rivet, or the like, 372, a spring 374, and a slidable member 376. The slidable member (FIG. 4 and FIGS. 5A and 5B) has a cylindrical opening sized large enough that a hub leg can be inserted therein, but small enough so as to press against an end of spring 374. The inside of the slidable member includes radially spaced ribs which provide slidable contact with the leg. For example, there may be six ribs, equally spaced from each other. The slidable member also has ears 378 which have slots 379 through which the rivet, pin, or the like, 372 extends. The preformed hub leg include aligned, diametrically opposed openings for receiving pin 372. This arrangement allows the slidable member 376 to slide on the hub leg to the distance defined by the length of the slots in ears 378. The spring 374 engages the side of the slidable member 376 farthest away from the hub body 310 so as bias the slidable member towards the hub body. The slidable member has a surface 380 (FIG. 4) which is sized to cooperate with locking member 360 on the hub body.

Figure 6A:
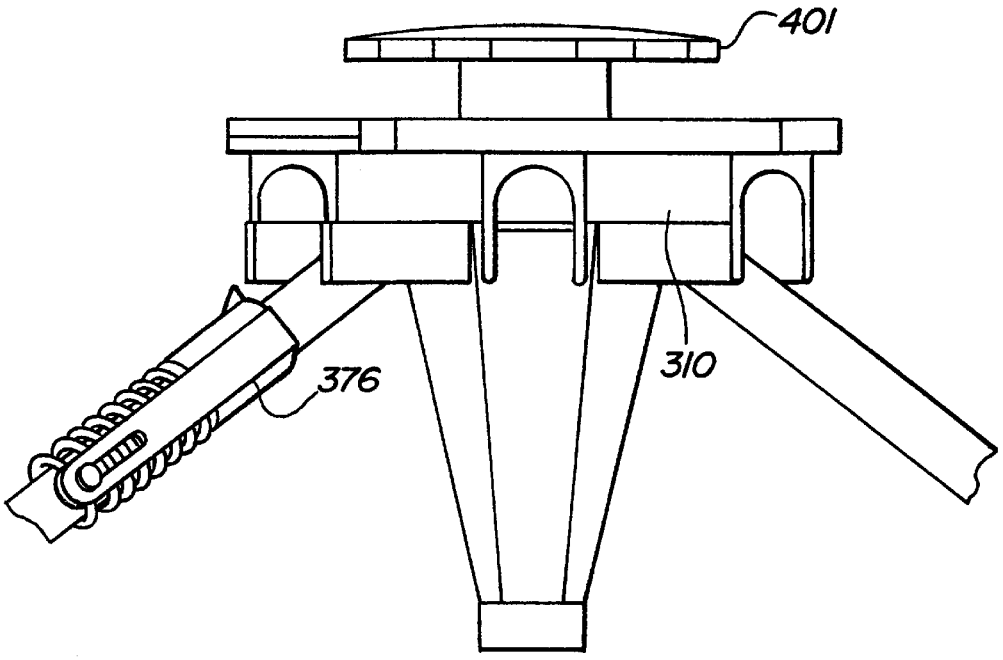
FIGS. 6A and 6B are perspective views of the hub body and hub legs.
Figure 6B:
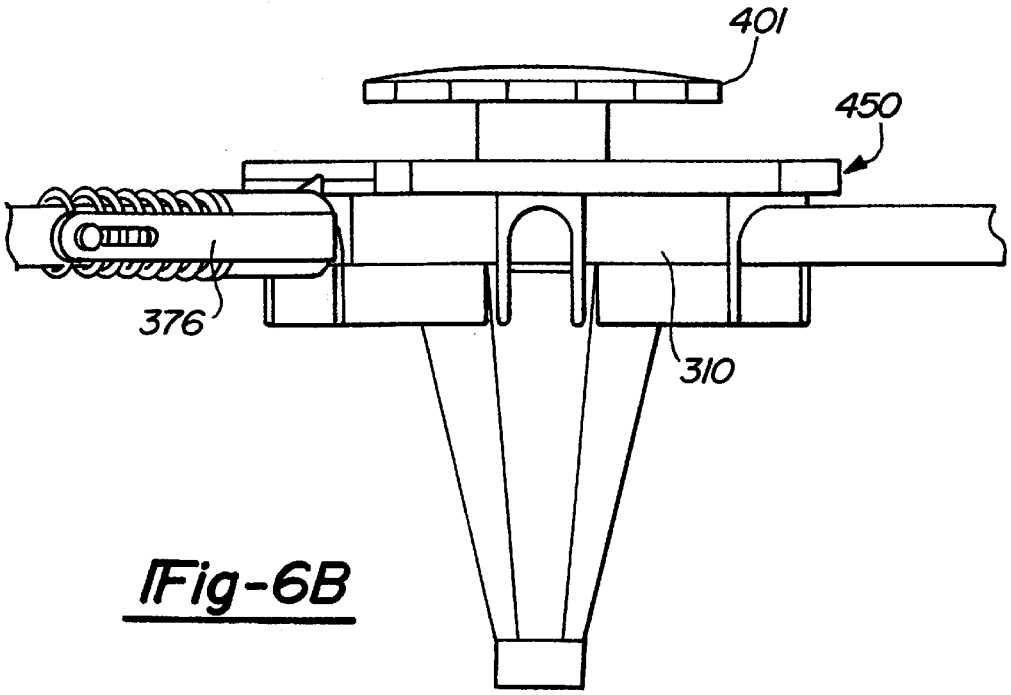

In operation, when a hub leg with engaging portion 370 thereon is pivoted from a folded to a horizontal position as in FIGS. 6A and 6B for erecting the playyard for use, the surface 380 of slidable portion 376 will be urged by spring 374 toward the hub body 310. Spring 374 will urge projection 381 against the hub body and the surface 380 over an upper surface 361 (FIG. 3) of locking member 360. As a result, the hub leg will be locked against pivotal movement.

As shown in FIG. 2, the invention includes a knob unit 400 and unlocking member 450. The unlocking member includes a hole in the center through which a portion of the knob unit can extend and an extended cylinder-shaped member 452. The lower portion of extended cylinder-shaped member 452 contains arced slots 453 in a number equal to locking mounting tabs 405 on the knob unit 400.

The knob unit includes a handle portion 401 shaped to guide one intuitively to rotate the handle portion, an extended cylinder-shaped member 403, and locking mounting tabs 405. A spring 408 which resists compression is sized to fit inside the handle portion 401 and member 403 so as to bias the handle portion away from unlocking member 450.

In assembly, the locking mounting tabs 405 are compressed to a smaller diameter and are inserted into extended cylinder-shaped member 452 through arced slots 453. Locking mounting tabs 405 have locking projections 406 which prevent the tabs 405 from being separated from the unlocking member after the tabs are inserted through slots 453. Further, when the handle portion 401 is rotated, the sides of tabs 405 will come into contact with the sides of slots 453 to cause the unlocking member 450 also to rotate.

Unlocking member 450 includes slots 455 for mounting the unlocking member through spider 350 to hub body 310 via shoulder screws 457. Unlocking member further includes cam surfaces 454 and 456.

Figure 7A:
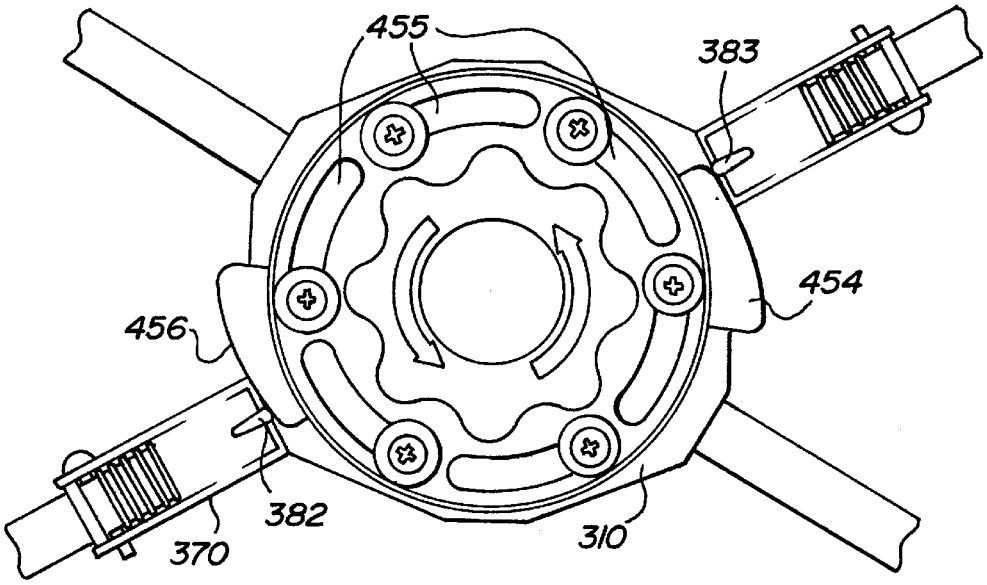
FIGS. 7A and 7B are perspective view showing operation of the unlocking member.
Figure 7B:
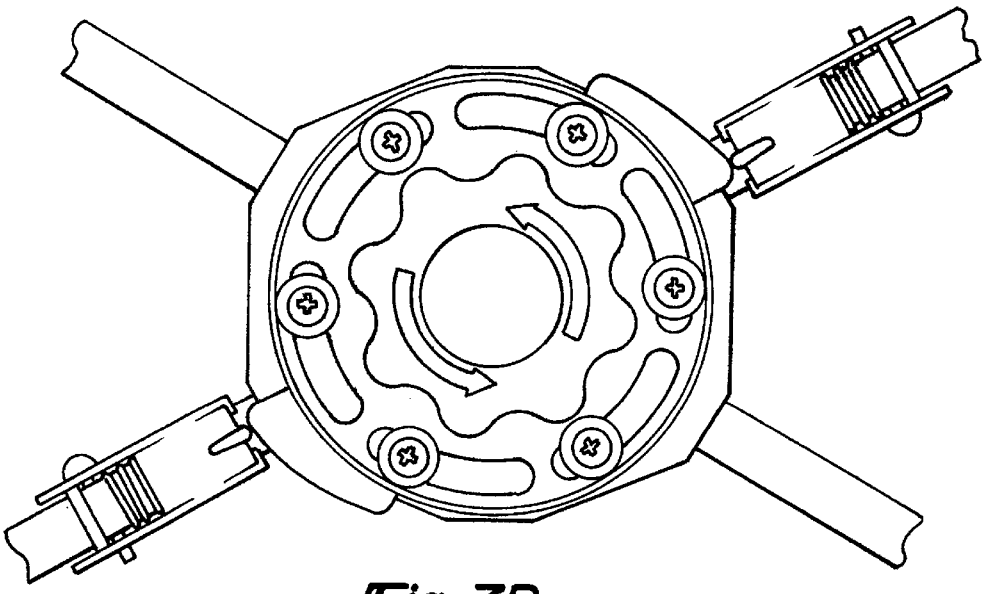

The operation of unlocking member 450 will be described with reference to FIGS. 7A and 7B. As shown in FIG. 7A, when the hub leg and the engaging portion 370 are in the locked position, the cam surfaces 454 and 456 will be in contact with engaging portion projections 382 and 383. The unlocking member will be spring biased (by spring 412) in a clockwise direction as shown in the FIG. 7A and thus the engaging portion will remain in a locked position. As shown in FIG. 7B, however, when knob unit 400 is rotated in the direction of the arrows on handle portion 401, cam surfaces 454 and 456 will ride against projections 382 and 383 so as to cause engaging portions 370 to move in a direction away from the hub body 310. The amount that unlocking member 450 is able to rotate is limited by slots 455 so as to prevent the cam surfaces from moving past projections 382 and 383. The movement of engaging portions 370 away from the hub body will result in freeing the hub legs for pivotal movement so that the playyard may be folded.

It will be apparent to those skilled in the art that various modifications and variations can be made in the foldable playyard with latch locking hub system of the present invention without departing from the spirit or scope of the invention. Thus, it is intended that the present invention cover the modifications and variations of this invention provided they come within the scope of the appended claims and their equivalents.

What is claimed is:

1. A foldable playyard comprising:

a lower frame assembly comprising a hub and a plurality of hub legs, one end portion of each of the hub legs pivotally coupled to the hub such that the hub can be collapsible from a substantially co-planar spread configuration wherein the hub legs diverge outwardly from the hub to a compact non-coplanar configuration where the hub legs can be positioned substantially parallel;

an upper frame assembly comprising a plurality of side rail units, each comprising a pair of rails and a medial rail connecting member pivotally connecting one end portion of each rail, said medial rail connecting member enabling the pair of rails to be collapsible from a substantially in-line configuration to a substantially V-shaped configuration; and corner legs for interconnecting the upper and lower frame assemblies, wherein the hub includes a locking member and at least one of the hub legs includes an engaging portion, slidably connected on the hub leg, adjacent to the locking member to prevent the hub leg from pivoting relative to the hub.

2. A foldable playyard according to claim 1, further comprising a plurality of upper connecting members and a corresponding number of lower connecting members, each of the upper connecting members being connected to an upper end portion of one of the corner legs and each of the lower connecting members being connected to a lower end portion of one of the corner legs, wherein end portions of the rail members are pivotally coupled to the upper connecting members and end portions of the hub legs are pivotally coupled to the lower connecting members.

3. A foldable playyard according to claim 2, wherein the lower frame assembly further comprises a pair of stabilizer legs pivotally coupled to the hub, the stabilizer legs being collapsible from a substantially co-planar spread configuration to a non-coplanar compact substantially parallel configuration.

4. A foldable playyard according to claim 1, wherein the locking member is fixed to the hub body.

5. A foldable playyard according to claim 4, wherein the hub body includes a first side and a second side opposite to the first side, the second side having a plurality of recesses dimensioned to accommodate the end portions of the hub legs.

6. A foldable playyard according to claim 1, wherein the slidably connected engaging portion is biased toward a locked position.

7. A foldable playyard according to claim 6, wherein the bias is provided by a spring and a pin member at one end thereof which is fixedly connected to the hub leg.

8. A foldable playyard according to claim 1, further comprising:

an unlocking member rotatively coupled to the hub.

9. A foldable playyard according to claim 8, wherein the unlocking member includes a cam surface.

10. A foldable playyard according to claim 9, wherein the cam surface cooperates with a surface on the engaging portion when the unlocking member is rotated.

11. A foldable playyard according to claim 8 wherein the unlocking member is biased towards a locked position.

12. A foldable playyard according to claim 11 wherein the bias is provided by a spring.

13. A foldable playyard according to claim 8, further comprising:

a knob unit operatively coupled to the unlocking member for rotating the unlocking member.

14. A foldable playyard according to claim 13, wherein the unlocking member further comprises a cam surface which cooperates with a surface on the engaging portion to free the hub leg to pivot relative to the hub when the knob unit is rotated a predetermined amount.

15. A foldable playyard according to claim 13, wherein the hub includes a first side and a second side opposite to the first side, the second side having a plurality of recesses dimensioned to accommodate the end portions of the hub legs such that the hub legs can be collapsible from a substantially co-planar spread configuration wherein the hub legs diverge outwardly from the hub to a compact non-coplanar configuration where the hub legs can be positioned substantially parallel wherein the knob unit is positioned adjacent to the first side of the hub body.

16. A foldable playyard according to claim 15, wherein the knob unit is biased away from the hub by a spring.

17. A hub system for connecting one end portion of each of a plurality of legs of a lower frame assembly of a playyard, comprising:

a hub body for pivotally coupling to one end portion of at least one leg;

a locking member on the hub body;

an engaging portion slidably connected on at least one leg and adjacent to the locking member for cooperating with the locking member to prevent the leg from pivoting whereby the hub legs can be collapsible from a substantially co-planar spread configuration wherein the hub legs diverge outwardly from the hub, to a compact non-coplanar configuration where the hub legs can be positioned substantially parallel.

18. A hub system according to claim 17, wherein the slidably connected engaging portion is biased towards a locked position.

19. A hub system according to claim 18, wherein the bias is provided by a spring and a pin member at one end thereof which is fixedly connected to the leg.

20. A hub system according to claim 17, further comprising:

an unlocking member rotatively coupled to the hub body.

21. A hub system according to claim 20, further comprising a knob unit operatively coupled to the unlocking member.

22. A hub system according to claim 20, wherein the unlocking member includes a cam surface.

23. A hub system according to claim 22, wherein the cam surface cooperates with a surface on the engaging portion when the unlocking member is rotated.

24. A hub system according to claim 20, wherein the unlocking member is biased towards a locked position.

25. A hub system according to claim 24, wherein the bias is provided by a spring.

26. A hub system according to claim 25, further comprising:

a knob unit operatively coupled to the unlocking member.

27. A hub system according to claim 26, wherein the unlocking member further comprises a cam surface which cooperates with a surface on the engaging portion to free the hub leg to pivot relative to the hub when the knob unit is rotated a predetermined amount.

28. A hub system according to claim 25, wherein the hub body includes a first side and a second side opposite to the first side, the second side having a plurality of recesses dimensioned to accommodate the end portions of the hub legs such that the hub legs can be collapsible from a substantially co-planar spread configuration wherein the hub legs diverge outwardly from the hub to a compact non-coplanar configuration where the hub legs can be positioned substantially parallel and wherein the knob unit is positioned adjacent to the first side of the hub body.

29. A hub system according to claim 28, wherein the knob unit is biased away from the hub body by a spring.

30. A hub system according to claim 17, wherein the hub body includes a first side and a second side opposite to the first side, the second side having a plurality of recesses dimensioned to accommodate the end portions of the hub legs.

31. A device for preventing pivotal movement of a leg, comprising:

a leg receiving body;

said leg pivotally coupled to the body;

a locking member on the body; and an engaging member slidably connected on the leg for cooperation with the locking member, the device adapted to prevent the pivoting of the leg from a substantially horizontal configuration to a substantially vertical configuration.

32. A device according to claim 31, further comprising:

an unlocking member rotatively coupled to the leg receiving body.

33. A device according to claim 32, wherein the unlocking member includes a cam surface.

34. A device according to claim 33, wherein the cam surface cooperates with a surface on the engaging member on the leg when the unlocking member is rotated.

35. A device according to claim 32, wherein the unlocking member is biased towards a locked position by a spring.

36. A device according to claim 32, further comprising a knob unit operatively coupled to the unlocking member.

37. A device according to claim 36, wherein the unlocking member further comprises a cam surface which cooperates with a surface on the engaging member to free the leg to pivot relative to the leg receiving body when the knob unit is rotated a predetermined amount.

38. A device according to claim 36, wherein the knob unit is biased away from the leg receiving body by a spring.

39. A device according to claim 31, wherein the slidably connected engaging member is biased towards a locked position.

40. A device according to claim 39, wherein the bias is provided by a spring and a pin member at one end thereof which is fixedly connected to the leg.

* * * * *